US009258854B2

(12) United States Patent
Deng

(10) Patent No.: US 9,258,854 B2
(45) **Date of Patent: *Feb. 9, 2016**

(54) LED PAR AND R LAMPS

(76) Inventor: Jia H. Deng, Diamond Bar, CA (US)

( * ) Notice: Subject to any disclaimer, the term of this patent is extended or adjusted under 35 U.S.C. 154(b) by 478 days.

This patent is subject to a terminal disclaimer.

(21) Appl. No.: 12/468,966

(22) Filed: May 20, 2009

(65) Prior Publication Data

US 2009/0323305 A1 Dec. 31, 2009

Related U.S. Application Data

(60) Provisional application No. 61/128,373, filed on May 20, 2008.

(51) Int. Cl.
*H01J 1/62* (2006.01)
*H05B 33/08* (2006.01)

(52) U.S. Cl.
CPC ..... *H05B 33/0803* (2013.01)

(58) Field of Classification Search
USPC ..... 362/84, 649, 650; 313/512
See application file for complete search history.

(56) References Cited

U.S. PATENT DOCUMENTS

| | | | | |
|---|---|---|---|---|
| 5,936,599 | A * | 8/1999 | Reymond | 345/82 |
| 6,504,301 | B1 | 1/2003 | Lowery | |
| 6,717,355 | B2 * | 4/2004 | Takahashi et al. | 313/503 |
| 7,479,662 | B2 | 1/2009 | Soules et al. | |
| 7,543,961 | B2 * | 6/2009 | Arik et al. | 362/294 |
| 7,883,242 | B2 * | 2/2011 | Ng et al. | 362/249.06 |
| 2002/0043926 | A1 | 4/2002 | Takahashi et al. | |
| 2004/0145288 | A1 | 7/2004 | Ouderkirk et al. | |
| 2005/0207152 | A1 | 9/2005 | Maxik | |
| 2010/0207509 | A1 * | 8/2010 | Deng | 313/483 |

* cited by examiner

*Primary Examiner* — John A Ward
(74) *Attorney, Agent, or Firm* — FSP LLC

(57) ABSTRACT

A PAR-type light bulb includes an LED lacking a phosphor coating, the LED covered by a lens having a phosphor coating, and a base comprising reverse threads.

3 Claims, 8 Drawing Sheets

LED PAR AND R LAMPS

PRIORITY

This application claims priority under 35 USC 119 to U.S. application Ser. No. 61/128,373 filed on Tuesday, May 20, 2008, which is presently pending and which is incorporated by reference herein in its entirety.

TECHNICAL FIELD

The present disclosure relates to LED lighting devices.

BACKGROUND

Conventional LED lights have met resistance in the consumer and commercial markets due among other things to high price in relation to compact fluorescent and incandescent bulbs. One factor in the high price of LED lighting is the need for A/C to D/C converters, also called LED driver circuits.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

References to "one embodiment" or "an embodiment" do not necessarily refer to the same embodiment, although they may.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list.

"Logic" refers to signals and/or information that may be applied to influence the operation of a device. Software, hardware, and firmware are examples of logic. Hardware logic may be embodied in circuits. In general, logic may comprise combinations of software, hardware, and/or firmware.

Those skilled in the art will appreciate that logic may be distributed throughout one or more devices, and/or may be comprised of combinations of instructions in memory, processing capability, circuits, and so on. Therefore, in the interest of clarity and correctness logic may not always be distinctly illustrated in drawings of devices and systems, although it is inherently present therein.

Figure 1:
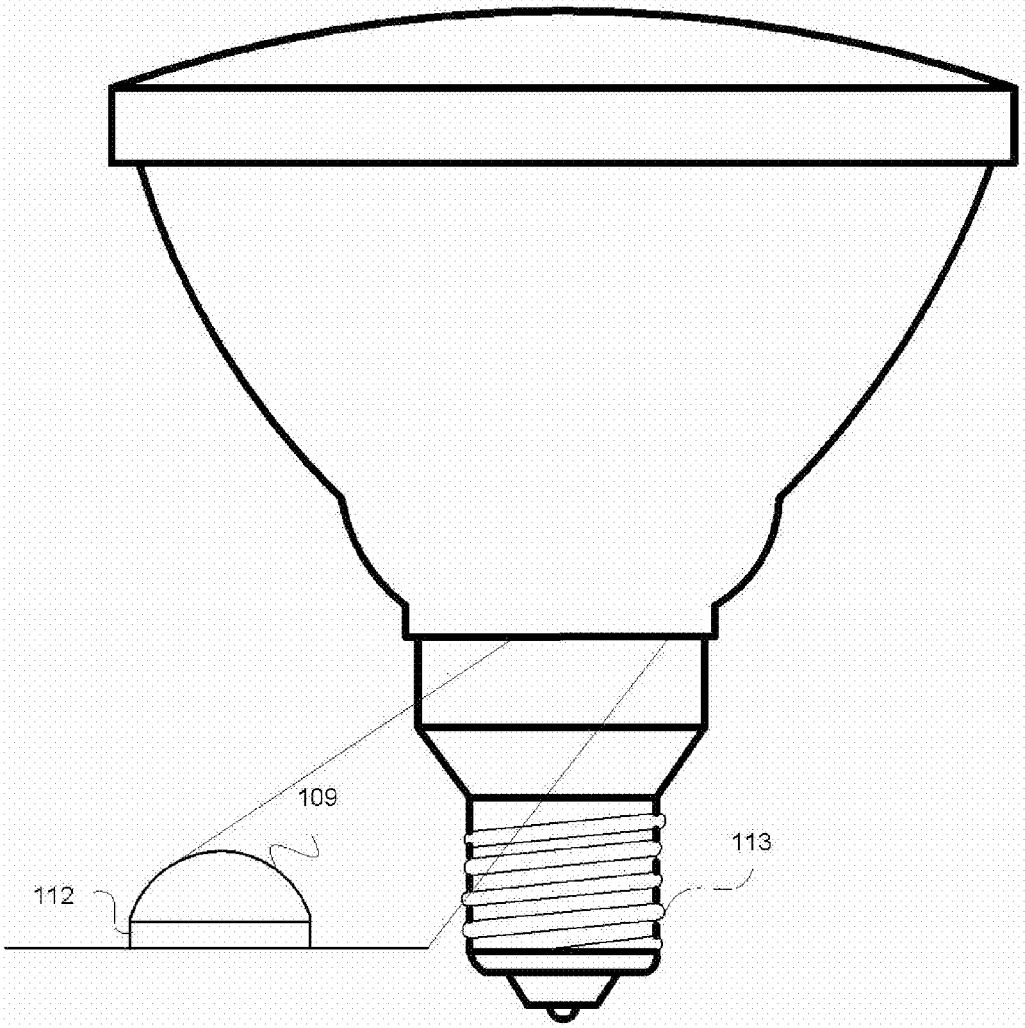
FIGS. 1-3 are illustrations of embodiments of PAR-type LED lighting devices having phosphor-coated lenses and reverse threads.
Figure 2:
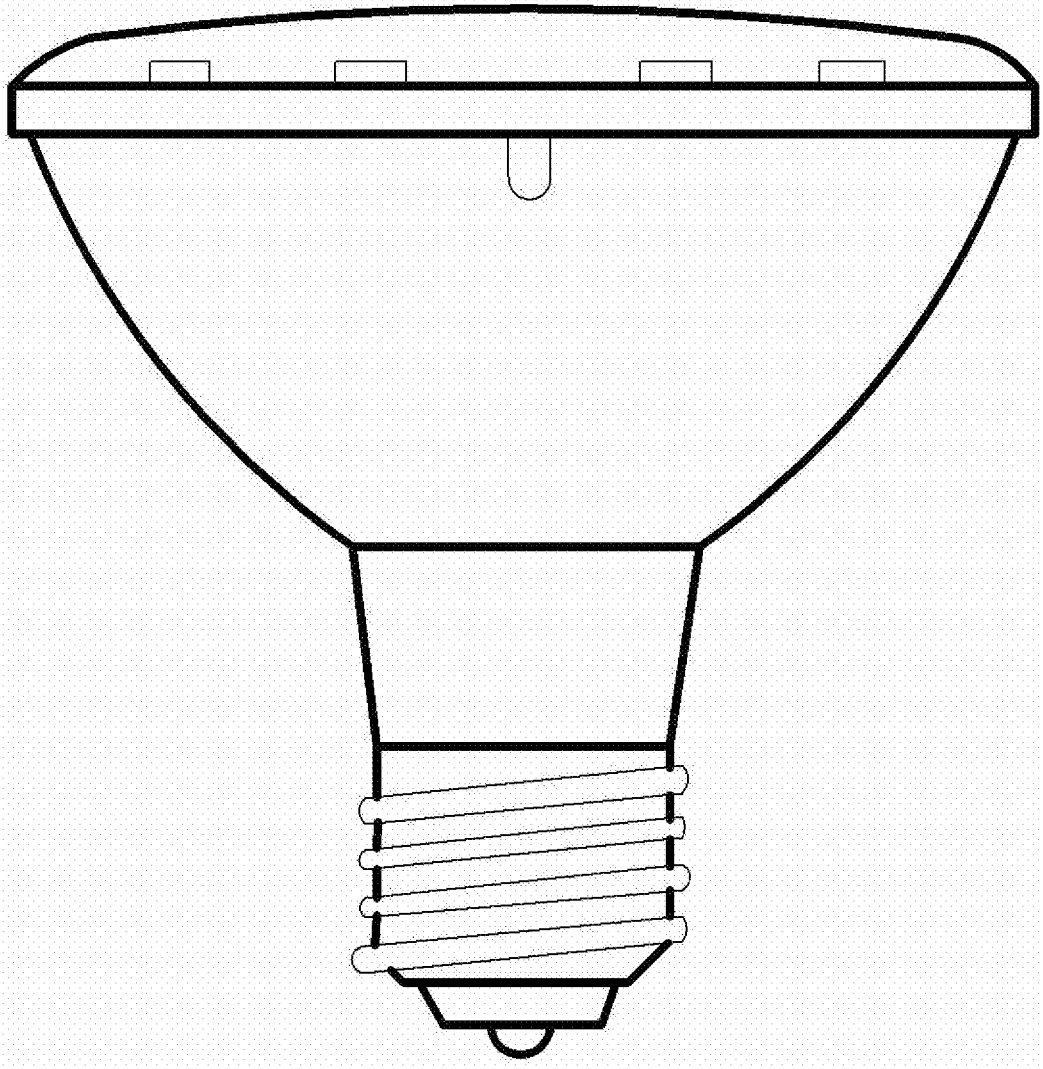
Figure 3:
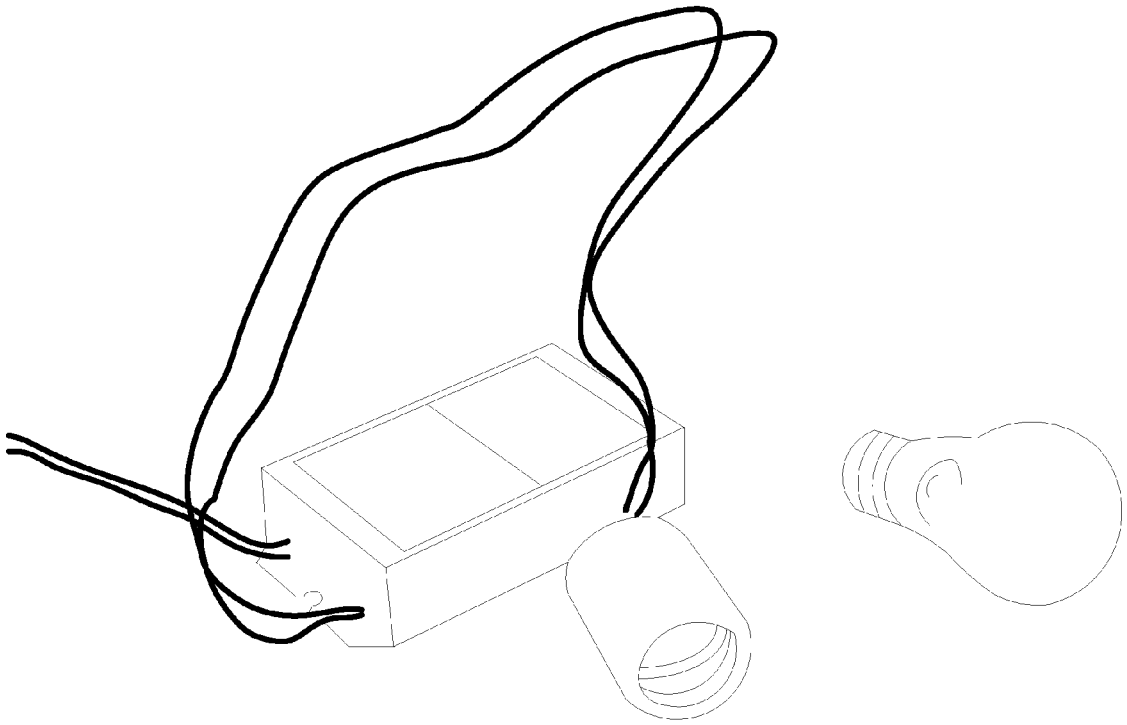

FIGS. 1-3 are illustrations of embodiments of PAR-type LED lighting devices having phosphor-coated lenses and reverse threads. The device comprises an LED 112 lacking a phosphor coating, wherein the LED 112 is covered by a lens 109 having a phosphor coating. Having the phosphor coating on the lens 109 and not the LED 112 may result in a more desirable light output, a softer appearance, and further, may enable the use of high-intensity LEDs where such LEDs would otherwise be impractical. For example, conventional LED light sources for indoor use have used lower intensity LEDs with the phosphor coating on the LED itself High-intensity LEDs have been avoided in certain indoor lighting applications because they are unpleasant on the eyes. Furthermore, a phosphor coating has been employed on LED itself and not a bulb over the LED, to maximize lumen output.

The PAR-type LED lighting devices may lack an internal DC LED driver, and may instead interface with an external Class 2 driver. The PAR-type LED lighting devices may further comprise reverse threads on the base 113. This may help ensure that only compatible lighting devices (e.g. devices not having an internal DC LED driver) may be inserted into the external Class 2 driver.

Figure 4:
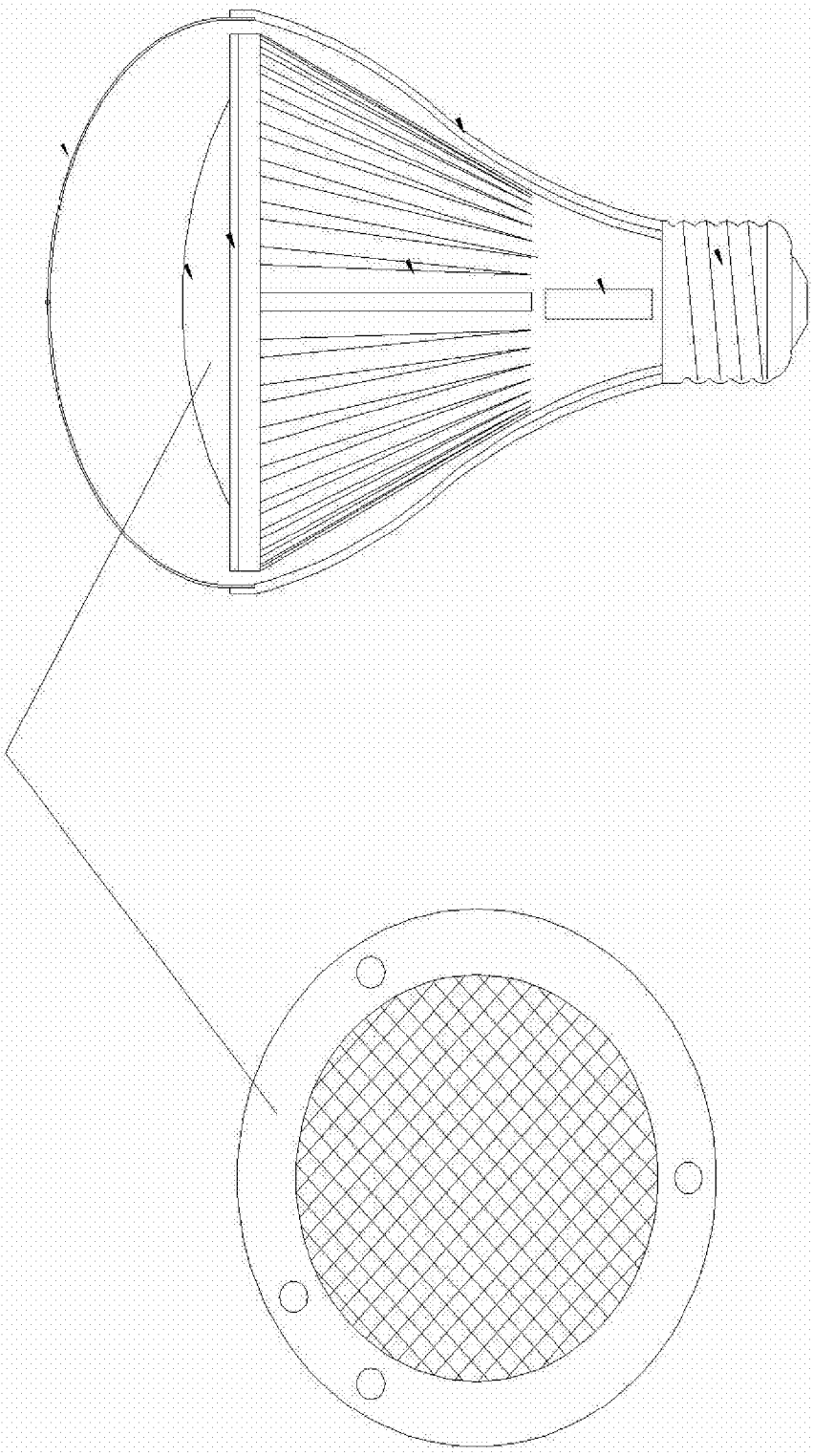
FIG. 4 is an illustration of an embodiment of an external Class 2 driver for LED PAR-type lighting devices, having reverse threads.

FIG. 4 is an illustration of an embodiment of an external Class 2 driver for LED PAR-type lighting devices, having reverse threads.

Figure 5:
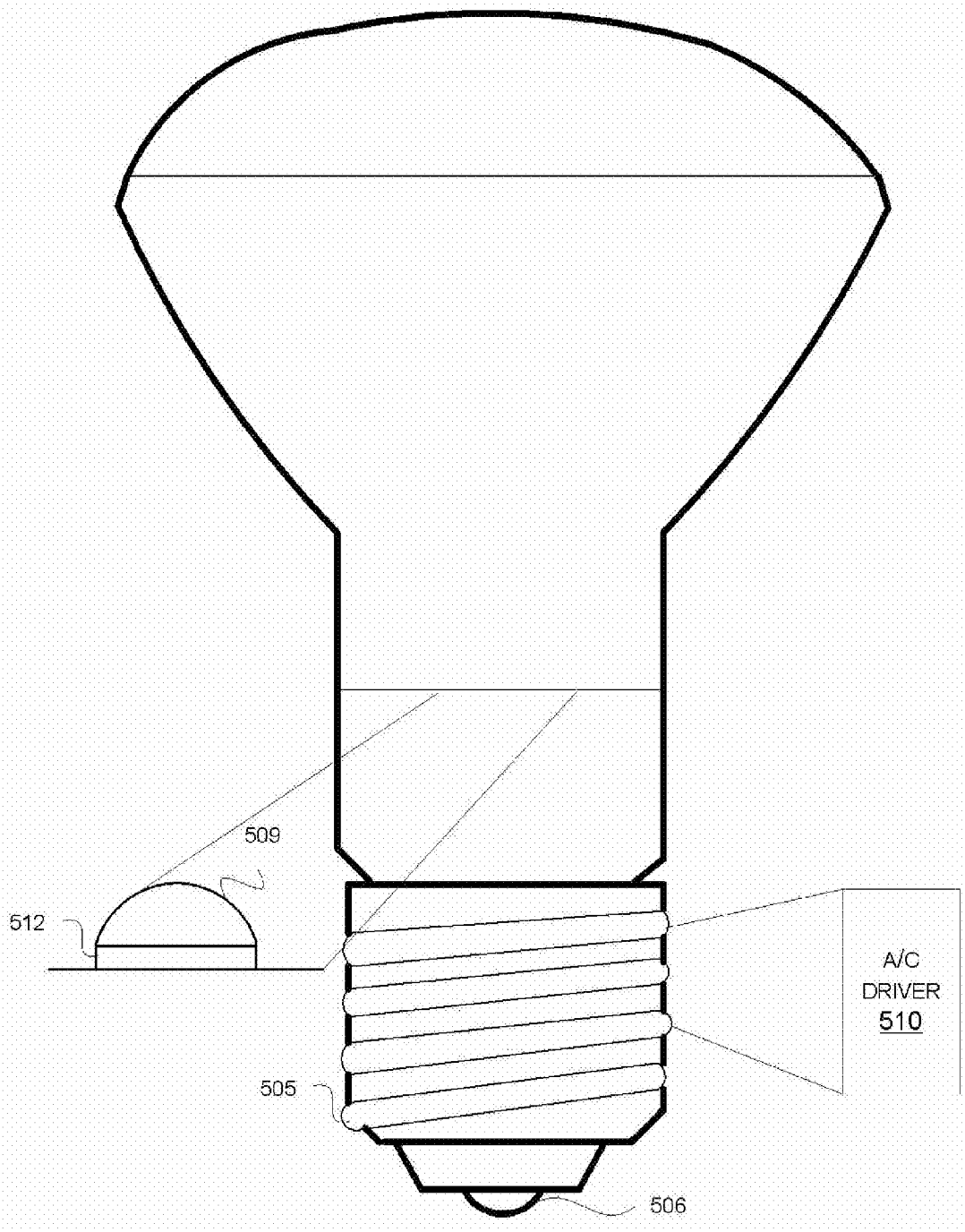
FIGS. 5-7 are illustrations of embodiments of R-type LED lighting devices having A/C drivers and phosphor-coated lenses.
Figure 6:
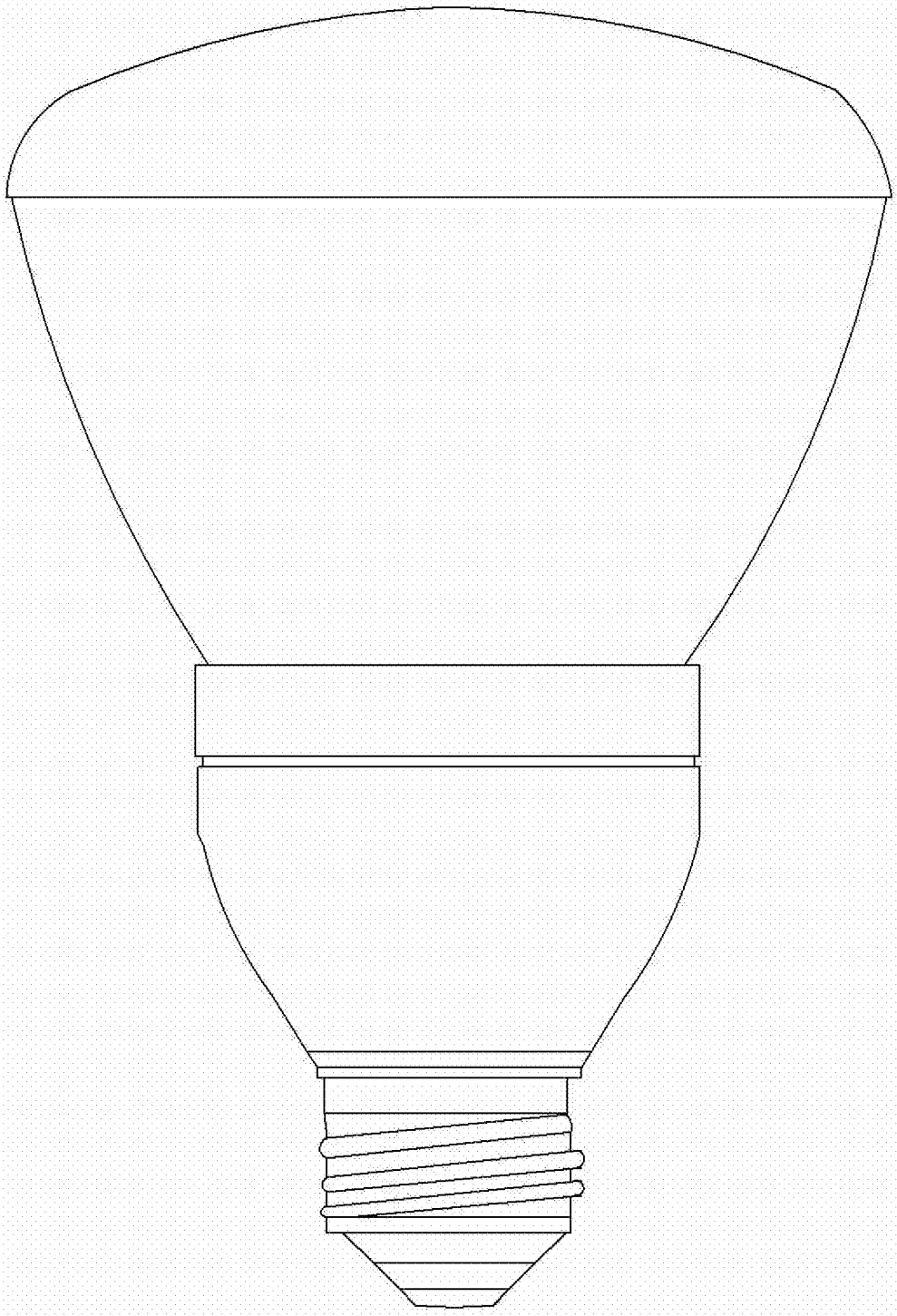
Figure 7:
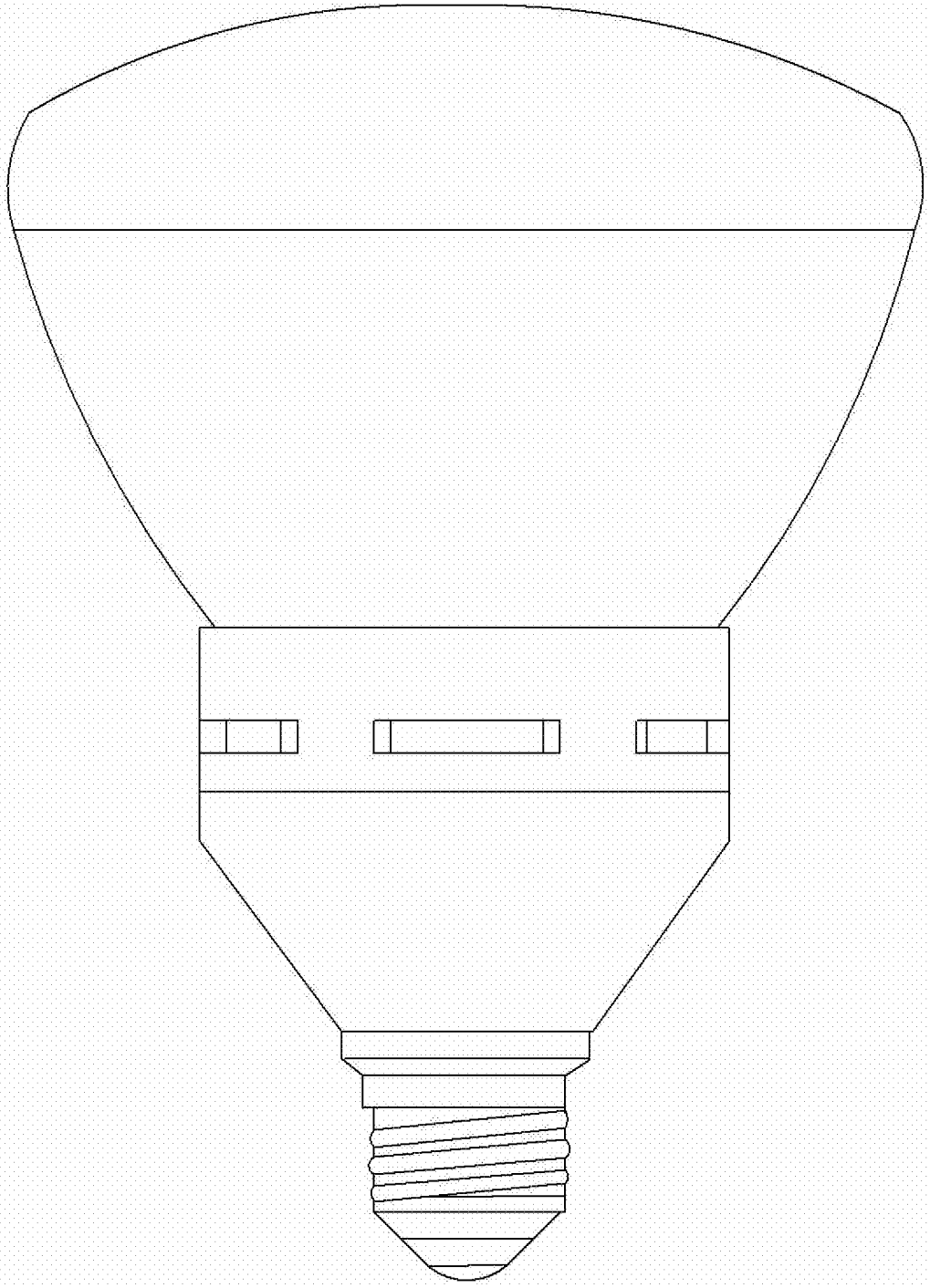

FIGS. 5-7 are illustrations of embodiments of R-type LED lighting devices using an A/C driven LED 512, phosphor-coated lens 509, and A/C driver logic 510. The driver logic 510 may, for example, be one of the simple circuits illustrated in FIG. 8. The device comprises an A/C driven LED 512 lacking a phosphor coating, wherein the LED 512 is covered by a lens 509 having a phosphor coating. Having the phosphor coating on the lens 509 and not the LED 512 may result in a more desirable light output, a softer appearance, and further, may enable the use of high-intensity LEDs where such LEDs would otherwise be impractical. For example, conventional LED light sources for indoor use have used lower intensity LEDs with the phosphor coating on the LED itself High-intensity LEDs have been avoided in certain indoor lighting applications because they are unpleasant on the eyes. Furthermore, a phosphor coating has been employed on LED itself and not a bulb over the LED, to maximize lumen output. The novel features of the bulbs described herein may overcome these limitations to some extent.

The device further includes a base 505 including an A/C electrical contact 506. Costs to manufacture and sell the light bulb may be substantially reduced due in part to the fact that the base circuitry lacks an A/C to D/C driver.

The device may operate at various A/C voltages including, for example, 120 V A/C as is used in many residential markets, 220 V A/C, 240 V A/C, and so on.

Figure 8:
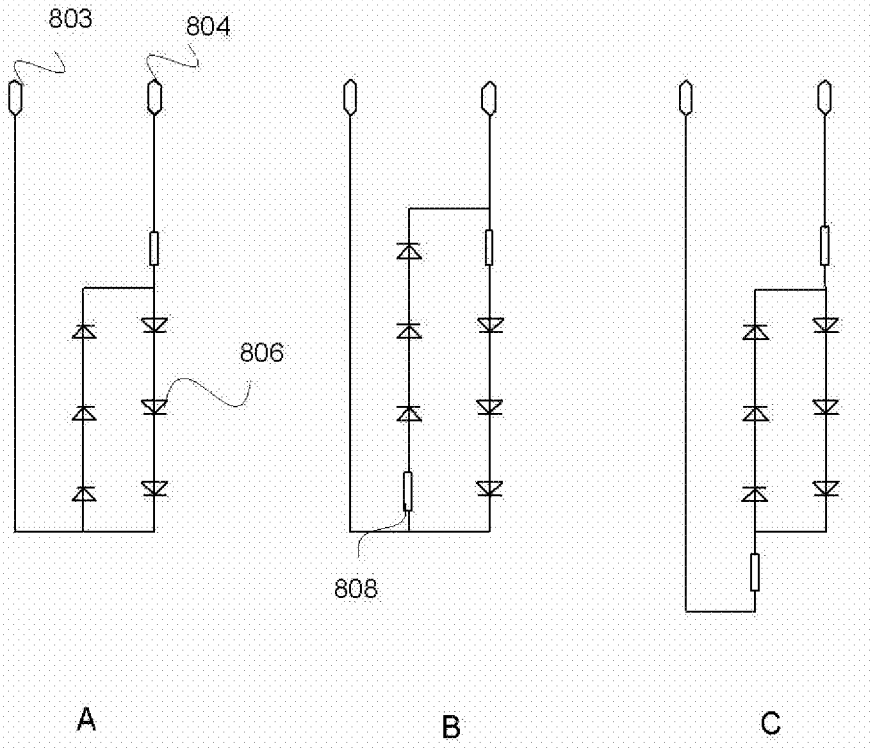
FIG. 8 is an illustration of an embodiment of a base circuitry for R-type LED lighting devices in conformance with the principles described herein.

FIG. 8 is an illustration of embodiments of base circuitry for R-type LED lighting devices in conformance with the principles described herein. The circuit embodiments include hot leads 804 and neutral leads 803. In many applications, either lead 803 804 may be connected to hot and the other to neutral. The number of emitting elements 806 that are employed in the LED may vary according to the operating voltage and possibly other parameters. Although six emitting elements 806 are shown, this is in fact a simplification for discussion purposes and in fact many more emitting elements 806 may be present. For example, in 120 V A/C applications there may be 68 emitting elements 806, and in 220 V A/C applications there may be 124 emitting elements. One or more resistive elements 808 are included at various points in the circuit, depending on the implementation. As FIG. 8 makes clear, the base circuitry may be very simple, comprising merely one or more inexpensive resistive elements. FIG. 8 circuits A-C show various manners of providing circuit protection with resistors. Circuit A provides some protection, Circuit B some additional protection over Circuit A, and Circuit C provides the best protection of the three.

Those having skill in the art will appreciate that there are various vehicles by which processes and/or systems described herein can be effected (e.g., hardware, software, and/or firmware), and that the preferred vehicle will vary with the context in which the processes are deployed. For example, if an implementer determines that speed and accuracy are paramount, the implementer may opt for a hardware and/or firmware vehicle; alternatively, if flexibility is paramount, the implementer may opt for a solely software implementation; or, yet again alternatively, the implementer may opt for some combination of hardware, software, and/or firmware. Hence, there are several possible vehicles by which the processes described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations may involve optically-oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood as notorious by those within the art that each function and/or operation within such block diagrams, flowcharts, or examples can be implemented, individually and/or collectively, by a wide range of hardware, software, firmware, or virtually any combination thereof. Several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in standard integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies equally regardless of the particular type of signal bearing media used to actually carry out the distribution. Examples of a signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment).

Those skilled in the art will recognize that it is common within the art to describe devices and/or processes in the fashion set forth herein, and thereafter use standard engineering practices to integrate such described devices and/or processes into larger systems. That is, at least a portion of the devices and/or processes described herein can be integrated into a network processing system via a reasonable amount of experimentation.

The foregoing described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

What is claimed is:

1. A PAR-type light bulb comprising:

an LED lighting element lacking a phosphor coating, the LED lighting element covered by a lens having a phosphor coating, and a base comprising reverse threads;

the LED lighting element comprising a plurality of LED emitters each adapted to illuminate upon the application of direct, unrectified A/C power, the LED emitters each lacking an internal phosphor layer;

the plurality of LED emitters coupled via purely resistive electrical elements to an A/C power input to the light bulb;

an inner bulb separate from the plurality of LED emitters and enclosing all of the LED emitters, with no intervening phosphor layer between any of the plurality of LED emitters and the inner bulb;

an outer bulb enclosing the inner bulb; and the inner bulb coated in phosphor.

2. The light bulb of claim 1, wherein the LED is directly powered through purely resistive elements by A/C power, and the base is lacking an A/C to D/C driver.

3. An R-type light bulb comprising:

a plurality of LED emitters each lacking a phosphor coating, the plurality of LED emitters enclosed by a lens having a phosphor coating, and the LED emitters coupled to an A/C power source by purely resistive elements;

each of the plurality of LED emitters adapted to illuminate upon the application of direct, unrectified A/C power, the LED emitters each lacking an internal phosphor layer;

the plurality of LED emitters coupled via purely resistive electrical elements to an A/C power input to the light bulb;

an inner bulb separate from the plurality of LED emitters and enclosing all of the LED emitters, with no intervening phosphor layer between any of the plurality of LED emitters and the inner bulb;

an outer bulb enclosing the inner bulb; and the inner bulb coated in phosphor.

* * * * *